US006655053B1

(12) United States Patent
Cummungs

(10) Patent No.: US 6,655,053 B1
(45) Date of Patent: Dec. 2, 2003

(54) TOOL ATTACHMENT FOR EXCAVATING MACHINES AND THE LIKE

(75) Inventor: David C Cummungs, Charlotte, NC (US)

(73) Assignee: Rockland, Inc., Bedford, PA (US)

( * ) Notice: Subject to any disclaimer, the term of this patent is extended or adjusted under 35 U.S.C. 154(b) by 572 days.

(21) Appl. No.: 09/139,607

(22) Filed: Aug. 25, 1998

(51) Int. Cl.[7] ..... E02F 3/96
(52) U.S. Cl. ..... 37/403
(58) Field of Search ..... 37/406, 403, 405, 37/404; 91/437; 60/414

(56) References Cited

U.S. PATENT DOCUMENTS

| | | | | | |
|---|---|---|---|---|---|
| 2,979,215 | A | * | 4/1961 | Brisson | 37/406 |
| 3,250,028 | A | * | 5/1966 | Hunger et al. | 37/406 |
| 3,595,411 | A | * | 7/1971 | Ables | 37/403 |
| 4,077,529 | A | * | 3/1978 | Leyrat et al. | 37/404 |
| 4,278,368 | A | * | 7/1981 | Livesay | 37/405 |
| 4,327,509 | A | * | 5/1982 | Bean | 37/404 |
| 5,269,382 | A | * | 12/1993 | Ottestad | 173/200 |
| 5,315,772 | A | * | 5/1994 | Lalonde | 37/403 |
| 5,417,064 | A | * | 5/1995 | Galuszka | 91/432 |
| 5,472,308 | A | * | 12/1995 | Somero | 37/406 |
| 5,522,221 | A | * | 6/1996 | Kadlicko et al. | 91/5 |
| 5,553,408 | A | * | 9/1996 | Townsend | 37/406 |
| 5,678,332 | A | * | 10/1997 | Hawkins | 37/406 |
| 5,733,059 | A | * | 3/1998 | Anderson | 37/403 |
| 5,797,461 | A | * | 8/1998 | Noble | 37/405 |
| 5,868,211 | A | * | 2/1999 | Bohn | 37/403 |
| 5,927,933 | A | * | 7/1999 | Tucker | 37/406 |

FOREIGN PATENT DOCUMENTS

| | | | | |
|---|---|---|---|---|
| SU | 624993 | * | 9/1978 | 37/403 |
| SU | 1583554 | * | 8/1990 | 37/403 |
| WO | 88003200 | * | 5/1988 | 37/403 |

* cited by examiner

*Primary Examiner*—Thomas B. Will
*Assistant Examiner*—Kristine Florio
(74) *Attorney, Agent, or Firm*—Stevens, Davis, Miller & Mosher, LLP

(57) ABSTRACT

An attachment for a machine having a handle, operable to perform various groundworking functions, generally consisting of an arm member pivotally connectable to the handle of the machine, an extendable strut pivotally connected to the arm member and pivotally connectable to the handle when the arm member is connected to the handle of the machine and at two tools, any selected one of which is detachably mountable on the arm member.

21 Claims, 2 Drawing Sheets

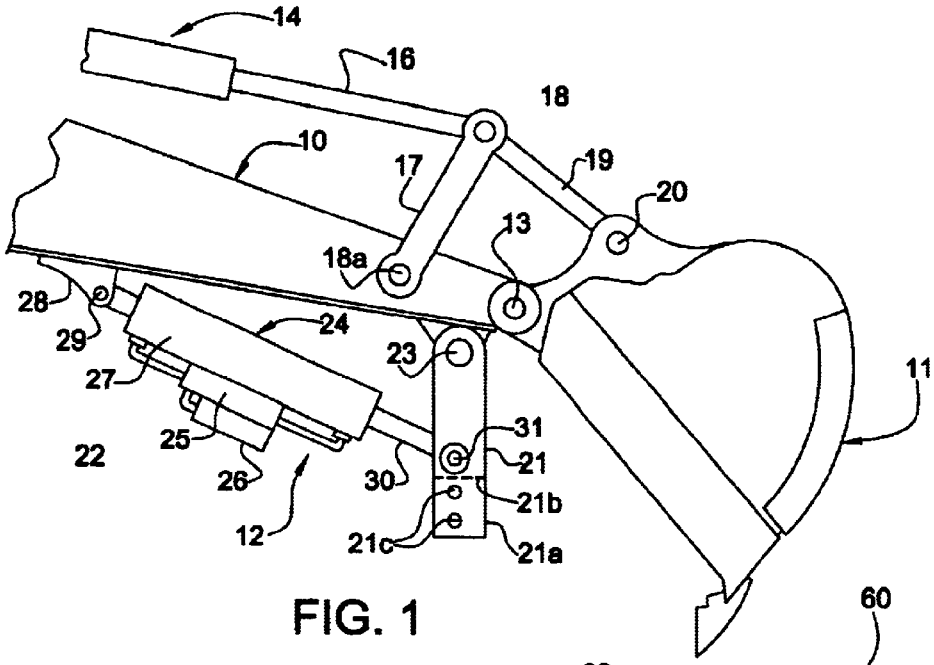
FIG. 1
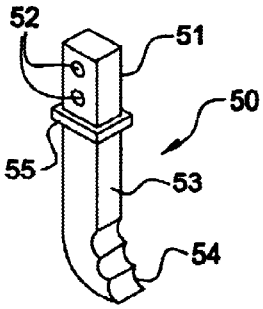
FIG. 3
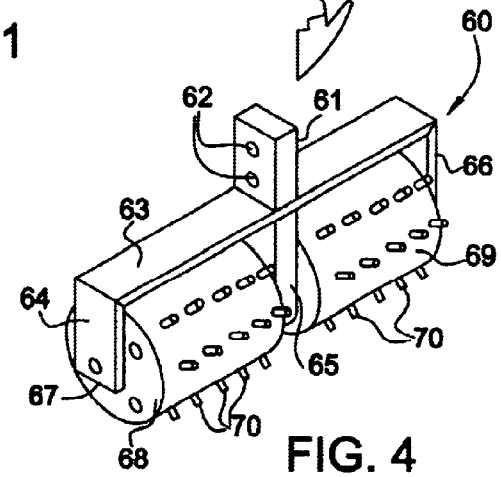
FIG. 4
FIG. 7
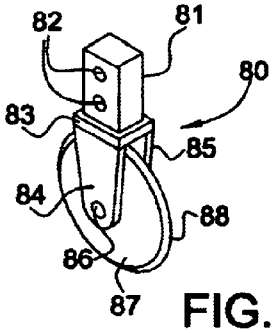
FIG. 5
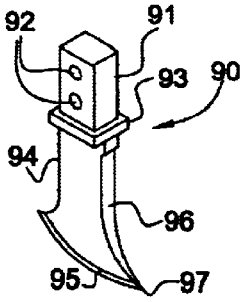
FIG. 6
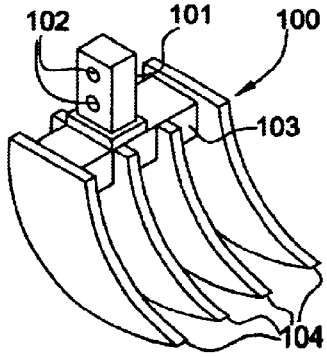

TOOL ATTACHMENT FOR EXCAVATING MACHINES AND THE LIKE

BACKGROUND OF THE INVENTION

In performing various groundworking operations, if often is required to use different types tools to accomplish a particular task. The task may involve ripping or cutting a surface area and excavating, grading and compacting an area, splitting stumps and the like and excavating or raking debris and variety of other multiple operations to accomplish a particular task. Typically, it has been the conventional practice in performing such tasks to either utilize separate pieces of equipment or to change tools on a single piece of equipment which in either circumstance requires an increase in capital investment, unproductive downtime and/or increased operation costs. It thus has been desirable and the principal object of this invention to provide an attachment for a machine such as an excavator providing multiple tools capable of performing multiple operations in accomplishing a particular task.

SUMMARY OF THE INVENTION

The present invention generally provides for an excavating machine and like having a handle, operable to perform groundworking functions, consisting of an arm member pivotally connectable to the underside of the machine handle, an extendable strut pivotally connected to the arm member and pivotally connectable to the under side of the machine handle when the arm member is connected to such handle, and at least two tools, each detachably mountable on the arm member. Preferably, the extendable strut consists of a hydraulic cylinder assembly having a cylinder member pivotally connected to the machine handle and a rod member pivotally connected to the arm member when the attachment is connected to the machine handle, means intercommunicating the base and rod ends of the cylinder member, a valve disposed in the intercommunicating means, selectively operable to open the valve and prevent the free flow of fluid between the base and rod ends of the cylinder member, and correspondingly the angular displacement of the arm member relative to the handle upon maneuvering of the handle by an operator of the machine, and to close the valve and preclude the free flow of fluid between the base and rod ends of the cylinder member, and correspondingly the angular displacement of the arm member relative to the handle, and means for operating such control valve. The tools detachably mountable on the arm member are interchangeable and may include a ripping tooth, a ground compactor, circular cutter, a stump splitter, a rake and the like. Such detachably mountable tools may be operated independently or with another component of the handle such as an excavating bucket to permit multiple ground working functions in accomplishing a particular task.

BRIEF DESCRIPTION OF THE DRAWINGS

FIG. 1 is a side view of the front end assembly of an excavating machine embodying the present invention, having a portion thereof broken away;

FIG. 3 is perspective view of a ripper tooth which may be detachably mountable on the arm member of the attachment shown in the FIG. 1;

FIG. 4 is perspective view of a compactor which may be detachably mountable on the arm member of the attachment shown in FIG. 1;

FIG. 5 is a perspective view of a circular cutter detachably mountable on the arm member of the attachment shown in FIG. 1;

FIG. 6 is a perspective view of a stump splitter which may be detachably mountable on arm member of the attachment shown in FIG. 1; and FIG. 7 is a perspective view of a rake detachably mountable on the arm member of the attachment shown in FIG. 1.

DESCRIPTION OF THE PREFERRED EMBODIMENT OF THE INVENTION

Figure 2:
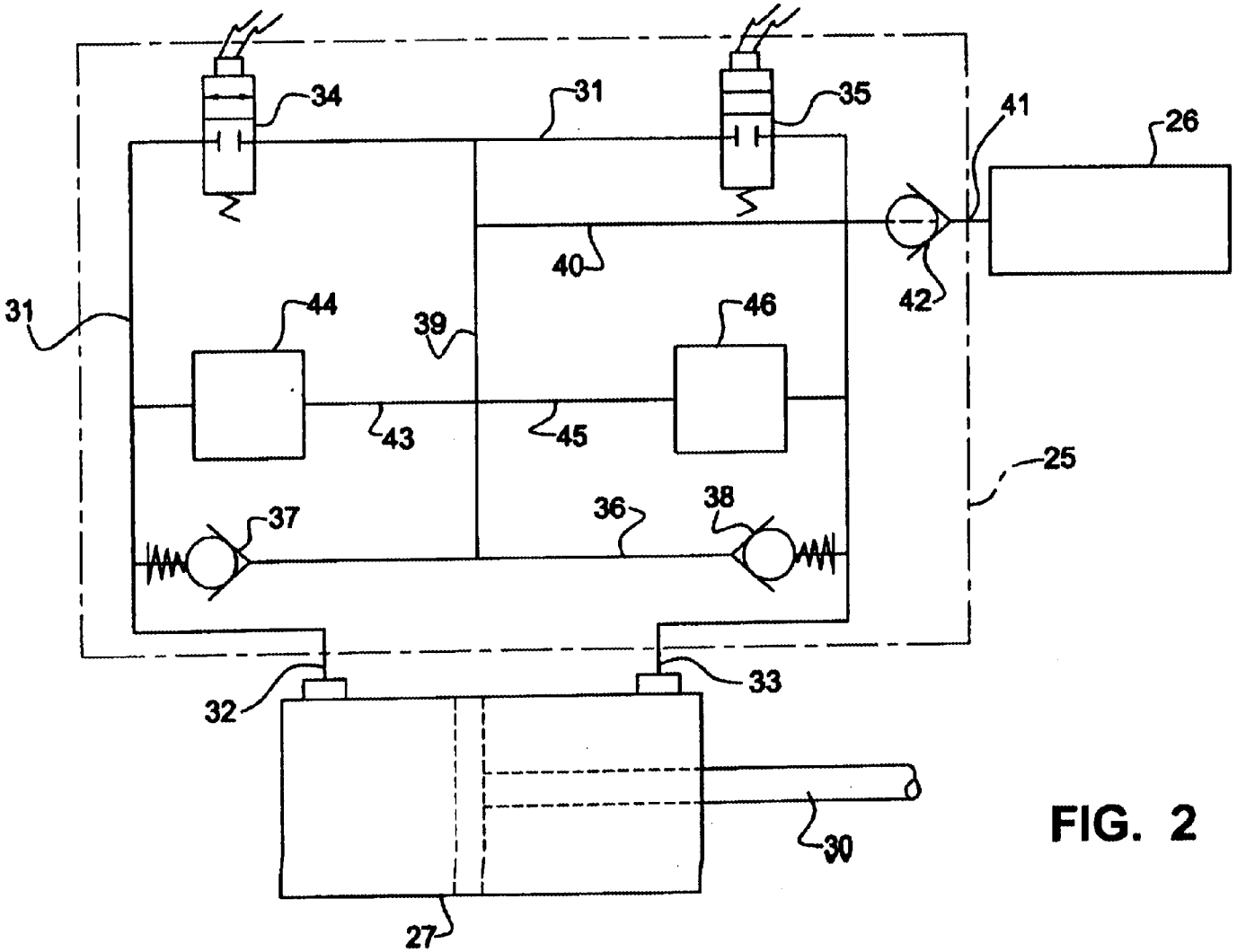
FIG. 2 is a diagrammatic drawing of a fluid control system of the attachment shown in the FIG. 1.

Referring to FIG. 1 of the drawings, there is shown a handle 10 operatively connected to a boom of an excavator machine, a bucket 11 pivotally mounted on handle 10 and a tool attachment 12 mounted on the underside of the handle adjacent the free end thereof. The handle is pivotally connected to the boom of the machine, the boom is pivotally connected to a rotatable frame of the machine and hydraulic cylinder assemblies operatively interconnect the machine frame and boom and the boom and the handle for angularly displacing and thus maneuvering such components in the conventional manner. Bucket 11 is pivotally connected to the end of the handle by means of a connecting pin 13 and is pivoted by means of a hydraulic cylinder assembly 14. The hydraulic cylinder assembly is of a conventional type having a cylinder member 15 pivotally connected to a bracket mounted on the upper side of handle 10 and an extendable rod member 16 pivotally connected to a support link 17 by means of a connecting pin 18. Support link 17 is pivotally connected to handle 10 by a connecting pin 18*a*. Motion is transmitted from support link 17 to bucket 11 by means of a connecting link 19 pivotally connected to support link 17 by means of connecting pin 18 and pivotally connected to bucket 11 by means of a connecting pin 20.

Attachment 12 generally consists of an arm member 21, a tool selected from the group of tools shown in FIGS. 3 through 7 detachably mountable on the free end of arm member 21 and extendable strut assembly 22. Arm member 21 is pivotally connected to a depending bracket 23 rigidly secured to the underside of handle 10 adjacent to connecting pin 13, and is provided with a bifurcated end portion 21*a* defining a slot 21*b* for receiving a shank portion of one of the tools shown in FIGS. 3 through 7 for detachably securing such tool to the end of the arm member. The lower bifurcated portion of the arm member further is provided with a transversely aligned bolt receiving openings 21*c* which are adapted to register with openings in the shank portion of a tool received within the slot in the arm member for receiving fastening bolts therethrough.

Strut assembly 22 includes a hydraulic cylinder assembly 24, a control valve 25 and accumulator 26. The cylinder assembly consist of a cylinder member 27 connected at its base end to depending bracket 28 mounted on the underside of handle 10 by means of a connecting pin 29, and a rod member 30 pivotally connected to an intermediate portion of arm member 21 by means of a connecting pin 31. Control valve 25 and accumulator 26 are mounted on cylinder member 27 which functions to control the intercommunication of fluid between the base and rod ends of cylinder member 27.

As best shown in FIG. 2, valve 25 includes a fluid passageway 31 intercommunicating the base and rod ends of cylinder member 27 by means of fluid lines 32 and 33, having a pair of electrically actuated valves 34 and 35 normally disposed in the closed condition, and a fluid passageway 36 interconnecting portions of fluid passageway 31, disposed parallel to a segment of fluid passageway 31 including valves 34 and 35, and including a pair check valves 37 and 38 permitting fluid flow therefrom only in the direction of segments of fluid passageway 31. Fluid passageway 31 and passageway 36 are interconnected by means of a fluid passageway 39 interconnecting a portion of passageway 31 disposed between valves 34 and 35, and a portion of passageway 36 disposed between check valves 37 and 38. A fluid passageway 40 intercommunicates passageway 39 and a fluid line 41 of accumulator 26, and includes a check valve 42. Valve 42 is provided with an orifice and functions in a manner to provide restricted flow of fluid from passageway 39 into accumulator 26 and unrestricted flow of fluid out of the accumulator into passageway 39. Valve 25 further includes a fluid passageway 43 intercommunicating a portion of fluid passageway 31 between fluid line 32 and valve 34, and fluid passageway 39, including a pressure relief valve 44. Valve 25 also is provided with a passageway 45 intercommunicating fluid passageway 39 and a portion of passageway 31 between valve 35 and fluid line 33, which includes a pressure relief valve 46.

Control valve 25 is selectively operable to open, permitting the free flow of fluid between the base and rod ends of cylinder member 27 and thus an adjustment of its length and correspondingly the angular adjustment of the arm member relative to the handle, and to close, precluding the free flow of fluid between the base and the rod ends of the cylinder member, thus fixing its length and correspondingly the angular relationship of the arm member relative to the handle. In the condition as shown in FIG. 2, intercommunication of fluid between the base and rod ends of the cylinder member is precluded. Whenever it is desired to adjust the angular relationship of arm member 21 relative to handle 10 by adjusting the length of the strut assembly, the machine operator need only operate controls at the operator's station on the machine to open valves 34 and 35, maneuver the boom and handle to cause arm member 21 to pivot and thus assume a different angular relationship relative to the handle, and then close valves 34 and 35 to lock the strut assembly and thus fix the angular relationship of the arm member relative to the handle.

When valve 34 is in the open condition and the operator operates the controls of the machine to cause the lower end of the arm member to engage the ground and pivot rearwardly to shorten the length of the strut assembly, fluid will flow from the base end of cylinder member 27 through fluid line 32, fluid passageway 31 including valve 34, fluid passageway 39, fluid passageway 36 including check valve 38, a segment of fluid passageway 31 and fluid line 33 into the rod end of the cylinder member. Excess of fluid from the base end of cylinder member 27 would be caused to flow through passageway 40 and check valve 42 into the accumulator. When the position of the arm member is set at the desired angle relative to the handle and it is desired to lock the arm member in such position, the operator merely operates the controls at his station to close valve 34 to preclude intercommunication between the base and rod ends of the cylinder member and correspondingly fix the length of the strut assembly.

When the machine operator opens valve 35 and maneuvers controls of the machine to cause arm member to engage the ground and be pivoted forwardly to extend rod member 30, fluid will be caused to flow out the rod end of the cylinder member through fluid line 33, a portion of fluid passageway 31 including valve 35, passageway 39, a portion of fluid passageway 36 including check valve 37, a portion of fluid passageway 31 and fluid line 32 into the base end of the cylinder member. Since the volume of the chamber at the rod end of cylinder member 27 is less than the volume of the chamber at the base end of the cylinder member, and there accordingly would be a deficiency of fluid flowing from the rod end to the base end of the cylinder member, such deficiency is compensated for by fluid supplied by accumulator 26 through check valve 42 and fluid passageway 40.

A selected one of the tools shown in FIGS. 3 through 7 may be detachably connected to the lower end of arm member 21 to provide an additional tool which may be operated solely and independently of, concurrently with or sequentially with bucket 11. The tool shown in FIG. 3 consists of a ripping tooth 50 which includes an upper shank portion 51 having a pair of spaced, transversely disposed bolt openings 52, a lower shank portion 53 provided with a jagged edge 54 and a peripheral flange portion 55. Ripping tooth 50 may be secured to the lower end of arm member 21 simply by inserting the upper shank portion thereof into the lower recess or socket in the lower end of arm member 21 so that peripheral flange portion 55 engages the lower edge of the arm member and bolt holes 52 register with bolt holes 21c in the arm member, and then inserting bolts in the registered openings of the two members to rigidly secure the members together.

The tool illustrated in FIG. 4 consists of a ground compactor 60 and includes an upper shank portion 61 comparable to upper shank portion 51 of ripping tooth 50, having a pair bolt holes 62, a transverse beam portion 63, a set of depending leg portions 64, 65 and 66 in which there is provided a shaft 67 and pair of cylindrical drums 68 and 69 rotatively mounted on shaft 67 and having a plurality of radially projecting studs 70. Compactor 60 may be detachably connected to arm member 21 in the same manner as ripping tooth 50 simply by maneuvering the front end of the machine to receive upper shank portion 61 so that bolt holes 62 register with bolt holes 21*c* in the lower end of the arm member, and inserting bolts through the registered holes to secure the compactor to the arm member.

The tool shown in FIG. 5 consists of a pavement cutter 80 which includes an upper shank portion 81 comparable to upper shank portion 61 of compactor 60 and upper shank portion 51 of ripping tooth 50, provided with a pair of vertically spaced bolt holes 82, a peripheral flange portion 83, a pair of depending portions 84 and 85 provided with a shaft 86 and a cutter blade 87 mounted on shaft 86 and having a circular cutting edge 88. The cutter also may be detachably connected to arm member 21 by inserting upper shank portion 81 into the lower end of arm member 21 and inserting a set of bolts in registered bolt holes 21*c* and 82.

The tool shown in FIG. 6 consists of a stump splitter 90 which includes an upper shank portion 91 comparable to shank portions 51, 61 and 81, having a pair of vertically spaced bolt holes 92, a peripheral flange portion 93 and a depending blade portion 94 provided with a bottom, arcuate cutting edge 95 and front, arcuate cutting edge 96 cooperating with bottom edge 95 to provide a point 97. The splitter is detachably connectable to arm member 21 in the same manner as the previously described tools with upper shank portion 91 being inserted into the lower end of the arm member and secured thereto by bolts extending through registered openings 21*c* and 92.

The tool illustrated in FIG. 7 consists of a rake 100 and includes an upper shank portion 101 comparable to the previously described upper shank portions of the aforementioned tools, having a pair of vertically spaced bolt holes 102 registerable with bolt holes 21*c* in the arm member, a transverse beam portion 103 and plurality of downwardly and forwardly curved tine portions 104. Here again, rake 100 may be detachably connected to arm member 21 by maneuvering the front end assembly of the machine to cause upper shank portion 101 to be received within the lower end of arm member 21, and then inserting bolts in registered bolt holes 21*c* and 102.

In the use of the attachment as shown, control valve 25 and the front end assembly of the machine may be operated to position arm member 21 in a fully retracted position, clear of the pivotal movement of bucket 11. With the arm member thus retracted, the front end assembly of the machine may be operated to perform conventional excavating operations with bucket 11. When it is desired to perform a different operation such as ripping, compacting, cutting, splitting or raking without the use of bucket 11, suitable controls at the operator's station on the machine are operated to retract rod member 16 of cylinder assembly 14 and thus position bucket 11 in an upper and rearward position, valve 25 and other controls on the machine may be operated to position the arm member in the position shown in FIG. 1 for attaching one of the tools, one of the tools maybe attached to the arm member either by manually mounting the tool on the lower end of the arm member for maneuvering the front end assembly of the machine to cause the upper shank portion of one of the more heavier tools to be received within the lower end of the arm member, and securing it thereto with a set of bolts, operating valve 25 to permit free movement of rod member 30 and then operating the front end assembly of the machine to cause the tool mounted on the arm member to engage the ground and further causing the arm member to assume the desired angular relationship with the handle, and then operating control valve 25 to fix the length of the strut assembly and thus the angular relationship between the arm member and the handle. With the arm member thus positioned and the bucket in the upper retracted position, the front end assembly of the machine may be operated to perform a desired task with the attached tool.

With a tool attached to the arm member as described, the tool and the bucket may be used together or perhaps in sequence to perform further groundworking tasks. As an example, a tool may be used to rip, cut or rake a ground surface, the tool may be retracted and the bucket may be used to scoop up material which has been ripped, cut or raked, or the ground may be graded with the bucket and then compacted with the compactor. In addition, the rake could be used in conjunction with the bucket to grapple various materials such as debris, large rocks, tree trunks and the like.

The ability to detachably mount a selected tool to the arm member of the machine which may be used either independently or with the bucket provides an increased versatility permitting a greater number of tasks to be performed by the machine with a minimum amount of down time, resulting in greater productivity. Such versatility is made possible by the ability to detachably mount a plurality of different tools on the arm member of the machine which may be operated independent of the other tool mounted on the machine, in cooperation with such other tool or sequentially with such tool. Furthermore, such detachable tool either may be removed completely or positioned in a fully retracted position to permit the independent use of the other tool mounted on the handle. The attachment and detachment of the detachable tool may be accomplished simply by manually mounting the lighter weight tools or maneuvering the front end assembly of the machine for the heavier tools.

In the use of one of the detachable tools either independently of or with the other tool mounted on the handle, if an excessive load is applied to arm member 21 risking damage to the arm member or attached tool, pressure relief valves 44 or 46 will be cause to open providing intercommunication of fluid between the base and rod ends of cylinder member 27, thus permitting the angular displacement of the arm member to relieve it of any stress resulting from any undue load imposed thereon.

From the foregoing detailed description it will be evident that there are a number of changes, adaptations, and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. An attachment for a machine having a handle, operable to perform groundworking functions, comprising;

an arm member pivotally connectable to said handle;

a fluid actuated extendible strut with an accumulator pivotally connected to said arm member and pivotally connectable to said handle when said arm member is connected to said handle; and at least two tools, any selected one of which is detachably mountable on said arm member.

2. An attachment according to claim 1 wherein said extendible strut includes a hydraulic cylinder assembly having a cylinder member thereof pivotally connected to one of said handle and arm member and the rod member thereof pivotally connected to opposite ends of said handle and said arm member when said attachment is connected to said handle, means intercommunicating the base and rod ends of said cylinder member, a valve disposed in said intercommunicating means, selectively operable to open said valve and permit free flow of fluid between a base end and a rod end of said cylinder member, and correspondingly the angular displacement of said arm member relative to said handle upon maneuver of said handle by an operator of said machine, and to close said valve and preclude the free flow of fluid between the base and rod ends of said cylinder member, and correspondingly the angular displacement of said arm member relative to said handle, and means for operating said valve.

3. An attachment according to claim 2, wherein the accumulator is selectively communicable with variable volume chambers of said cylinder member for compensating for the fluid volume requirements of said chambers.

4. An attachment according to claim 2 wherein said valve is electrically actuated and operatively connectable to control means disposed on said machine.

5. An attachment according to claim 2 including a fluid passageway intercommunicating the base and rod ends of said cylinder member having a pressure relief valve operable to open upon attainment of a predetermined pressure in a chamber of said cylinder member.

6. An attachment according to claim 1 wherein each of said tools is detachably mountable on said arm member by bolting.

7. An attachment according to claim 1 wherein each of said tools includes a shank portion connectable to said arm member.

8. An attachment according to claim 7 wherein said shank portion is receivable within a slot provided within a bifurcated end portion of said arm member.

9. An attachment according to claim 8 wherein said shank portion of said tool is detachably mountable by bolting.

10. An attachment according to claim 7 wherein said shank portion is receivable within a socket disposed in an end portion of said arm member.

11. An attachment according to claim 10 wherein said shank portion is detachably mountable on said arm member by bolting.

12. An attachment according to claim 1 wherein one of said tools comprises a ripping tooth.

13. An attachment according to claim 1 wherein one of said tools comprises a compactor.

14. An attachment according to claim 13 wherein said compactor includes a rotatable, cylindrical drum having radially projecting studs.

15. An attachment according to claim 1 wherein one of said tools comprises a cutter.

16. An attachment according to claim 15 wherein said cutter includes a rotatable disc having a circular cutting edge.

17. An attachment according to claim 1 wherein one of said tools comprises a splitter.

18. An attachment according to claim 17 wherein said splitter includes a pointed portion.

19. An attachment according to claim 1 wherein one of said tools comprises a rake.

20. An attachment according to claim 1 including a second tool mountable on said handle operable independently of, in conjunctively with or sequentially with said detachably mountable tool.

21. An attachment according to claim 20 wherein said second tool comprises a bucket.

* * * * *